United States Patent [19]

Kunitz et al.

[11] 4,438,195

[45] Mar. 20, 1984

[54] PHOTOGRAPHIC RECORDING MATERIAL CONTAINING A DEVELOPER COMPOUND

[75] Inventors: Friedrich-Wilhelm Kunitz, Leverkusen; Karl-Wilhelm Schranz, Odenthal, both of Fed. Rep. of Germany

[73] Assignee: Agfa-Gevaert Aktiengesellschaft, Leverkusen, Fed. Rep. of Germany

[21] Appl. No.: 438,965

[22] Filed: Nov. 3, 1982

[30] Foreign Application Priority Data

Nov. 14, 1981 [DE] Fed. Rep. of Germany ..... 3145288

[51] Int. Cl.[3] ..... G03C 1/06

[52] U.S. Cl. ..... 430/566; 430/405; 430/380

[58] Field of Search ..... 430/405, 566, 380, 249, 430/404, 238, 235, 236

[56] References Cited

U.S. PATENT DOCUMENTS

| | | | |
|---|---|---|---|
| T888,011 | 7/1971 | Stauffer | 96/76 |
| 3,265,501 | 8/1966 | Johnston | 430/404 |
| 3,425,832 | 2/1969 | Bornemisza | 430/404 |
| 3,518,088 | 6/1970 | Dunn et al. | 430/466 |
| 4,144,065 | 3/1979 | Lambert et al. | 430/236 |

*Primary Examiner*—Mary F. Downey

*Attorney, Agent, or Firm*—Connolly & Hutz

[57] ABSTRACT

Silver halide developer compounds containing amino groups and attached in the form of a salt to ion exchangers are embedded in layers of photographic recording material comprising at least one silver halide emulsion layer. In color photographic recording materials, the silver halide emulsion layers may have color-providing compounds associated with them.

7 Claims, No Drawings

PHOTOGRAPHIC RECORDING MATERIAL CONTAINING A DEVELOPER COMPOUND

This invention relates to a photographic recording material comprising at least one light-sensitive silver halide emulsion layer and at least one silver-halide-developer compound contained in a layer.

The development of exposed photographic recording materials based on silver halides requires a treatment with silver-halide-developer compounds which are weakly reducing compounds capable of reducing exposed silver halide imagewise. The silver-halide-developer compounds are normally contained in liquid treatment baths. When the silver-halide-developer compounds are incorporated in layers of the photographic recording materials, it is possible to carry out the development in a simple alkaline treatment bath (activator bath) which serves merely to adjust the pH to a sufficiently high value for development but need not itself contain any developer compounds. Although this has the advantage of eliminating the sensitivity to oxidation of the treatment baths otherwise used for development, so that such activator baths are much more stable and durable than the treatment baths containing silver-halide-developer compounds, the stability of the photographic recording material generally suffers if the silver halide developer compounds are incorporated either as such or in a salt form in layers of the recording material, this lack of stability being in most cases manifested by a higher (silver or color fog, i.e. poorer whites.

It has for this reason been proposed to incorporate so-called masked silver-halide-developer compounds in the emulsion layers. In such compounds, the photographically-active groups, which are mainly phenolic hydroxyl groups and aromatic amino groups, are blocked, e.g. by acylation, so that their sensitivity to oxidation is suppressed.

The above mentioned groups are liberated in the alkaline medium used for development so that their photographic (developing) activity is completely released. Such masked silver halide developer compounds have been described, for example, in GB No. 632 836, GB No. 691 815 GB No. 783 887, BE No. 557 556, DE-AS No. 1 159 758, DE-AS No. 1 246 406, DE-AS No. 1 254 463 and DE-OS No. 28 18 919. Liberation of the silver-halide-developer from such masked compounds requires comparatively strong alkali and generally proceed too slowly at acceptable temperatures, particularly for modern color photographic processes where short development time are desired. The densities obtained with the masked silver halide developer compounds incorporated in the layers are therefore insufficient in most cases.

It is an object of the present invention to provide a photographic recording material comprising at least one silver halide emulsion layer containing incorporated silver-halide-developer compounds and capable of being developed to images with high maximum density (Dmax) and low fog (Dmin) by treatment with aqueous alkali. It has been found that this object may be achieved if the silver halide developer compound incorporated in a layer of the photographic recording material is attached in the form of a salt to an ion exchanger.

The present invention provides a photographic recording material comprising at least one light-sensitive silver halide emulsion layer and at least one layer containing a silver-halide-developer compound carrying an amino group, characterized in that the silver-halide-developer compound containing the amino group is contained in the layer as a substance attached in a salt-like form to an ion exchanger.

The photographic recording materials according to the invention thus comprise at least one layer containing an ion exchanger charged with silver-halide-developer compound containing amino groups. The ion exchanger functions as a carrier for the silver-halide-developer compound which contains amino groups.

These silver-halide-developer compounds containing amino groups are conventional silver-halide-developers of the kind used for black-and-white development [e.g.p-aminophenol, p-N-methylaminophenol, N-monohydroxyethyl-o-aminophenol, 2,4,6-triaminophenol ("Triamol"), 1-p-aminophenyl-3-iminopyrazolidine ("Phenimine") 1-phenyl-3-methyl-4-amino-5-pyrazolinone] or for chromogenic development (e.g. the p-phenyl-enediamine derivatives conventionally used as color developers). Common to all these silver-halide-developer compounds is the feature that they have at least one amino group attached to an aromatic ring.

Ion exchangers are high molecular weight compounds having acid or basic groups which are bound to a polymeric matrix and which are capable of reversibly binding certain oppositely charged ions.

Ion exchangers are subdivided according to the nature of their functional groups into cation exchangers (acid groups) and anion exchangers (basic groups). Within each of these two groups, the ion exchangers are further characterized, according to their strength as acids or bases, into strongly acidic, weakly acidic, strongly basic and weakly basic ion exchangers. Detailed information on ion exchangers may be found, for example, in Ullmann's Enzyklopädie der Technischen Chemie, 4th Edition, Volume 13, page 279 et seq and in the monograph by K. Dorfner, "Ionenaustauscher", published by De Gruyter Verlag, Berlin, 3rd Edition 1970.

For charging with silver-halide-developer compounds which contain amino groups but which are free from sulfo groups, such as N,N-diethyl-p-phenylenediamine, 2-amino-5-N,N-diethylaminotoluene, 2-amino-5-(N-ethyl-N-methyl-sulfoamidoethylamino)-toluene, 2-amino-5-(N-ethyl-N-hydroxyethylamino)-toluene and 2-amino-5-(N-ethyl-N-methoxyethylamino)-toluene, it is particularly suitable to use cation exchangers having strongly acidic groups, e.g. sulfo groups. Sulfonated polymers of styrene and divinylbenzene are examples of suitable cation exchangers. These strongly acidic cation exchangers are particularly suitable for being charged with amino group-containing silver-halide-developer compounds free from sulfo groups if they are present in the acidic form (H form). Ion exchangers in the salt form e.g. the Na-or K-form, are advantageously converted by the usual methods into the H-form in which they can readily take up the above mentioned amino group-containing silver-halide-developer compounds which are free from sulfo groups from the aqueous phase, even if the developer compounds are in the form of their salts. The charging capacities of two particular cation exchangers of this type, commercially available under the names of Lewatit® S 100 and Lewatit® SPC 118, were determined semiquantitatively for various developer compounds, with the following results:

| Ion exchanger (IA) | Developer (E) | Charge [Mol E/100 ml IA] |
|---|---|---|
| S 100 (H-form) | E 1 | 0.054 |
| | E 2 | 0.058 |
| | E 3 | 0.070 |
| SPC 118 (H-form) | E 1 | 0.047 |
| | E 2 | 0.040 |
| | E 3 | 0.050 |

E 1 = 2-Amino-5-(N—ethyl-N—methyl-sulfonamidoethylamino)toluene;
E 2 = 2-Amino-5-(N—ethyl-N—hydroxyethylamino)-toluene;
E 3 = 2-Amino-5-(N—ethyl-N—methoxyethylamino)-toluene.

In cation exchangers charged with silver-halide-developer compounds containing amino groups, the developer is so firmly attached that no free developer can be detected in the (neutral) wash water, as demonstrated by a test with couplers and persulfate in alkaline solution. Treatment with aqueous alkali (NaOH), on the other hand, instantly releases developer in large quantities.

When silver-halide-developer compounds containing both amino groups and sulfo groups, such as N-butyl-N-(ω-sulfobutyl)-p-phenylenediamine or 2-amino-5-(N-butyl-N-ω-sulfobutylamino)-toluene, are incorporated in photographic layers, it is particularly desirable to use strongly basic anion exchangers, preferably used in their alkaline form (OH form). The functional groups of these strongly basic ion exchangers are generally quaternary ammonium groups. For treatment with silver-halide-developer compounds containing sulfo groups, the anion exchangers are generally treated in their OH-form with an aqueous solution of the developer compounds, the latter being preferably used in the form of their sodium salts. The capacity to be charged with a particular silver-halide-developer compound containing sulfo groups and amino groups was determined, by way of example, for two particular anion exchangers available commercially under the names of Lewatit® M 500 and Lewatit® MP 500 A. The results obtained were as follows:

| Ion Exchanger (IA) | Developer (E) | Charge [Mol E/100 ml IA] |
|---|---|---|
| M 500 (OH form) | E 4 | 0.039 |
| MP 500 A (OH form) | E 4 | 0.04 |

E 4 = N—butyl-N—(ω-sulfobutyl)-p-phenylenediamine.

Large quantities of developer were again instantly released from the ion exchanger charged with developer when the ion exchanger was treated with an aqueous alkali (NaOH) or with aqueous solutions of alkali metal salts.

The ion exchangers charged with silver-halide-developer compounds are incorporated in one or more layers of a photographic recording material. For this purpose, the charged ion exchangers were first reduced to small particles with an average particle size of from 20 μm to 100 μm, to ensure as far as possible homogeneous distribution of the exchanger in the casting solution for the particular layer.

This size reduction may be carried out, for example, in an ordinary, commercially available, domestic mixer with rotary blades, optionally by introducing the ion exchanger in the form of an aqueous suspension which may contain a binder, e.g. gelatin. Another, preferred method of size reduction consists of grinding the ion exchanger charged with developer, e.g. in a ball mill. The ion exchangers charged with developer may then be cast in the form of aqueous suspensions containing binder to form separate layers or they may be added to the casting solution for some other layer which may be either light-sensitive or light-insensitive. The ion exchanger charged with developer is preferably incorporated in a layer of photographic material which is not photographically-active, e.g. an opaque layer or a layer of binder which is situated behind an opaque layer when the image is viewed. The minimum quantity to be used of ion exchanger charged with developer may easily be calculated from the charging capacity and from the theoretical requirement of developer for all the silver halide emulsion layers in the recording material and, if indicated, the amount of compounds present which are capable of coupling. The quantity of ion exchanger charged with developer may be increased above the minimum within wide limits.

As previously mentioned, the ion exchanger charged with silver-halide-developer compound is preferably present in a close spatial relationship to an opaque layer in the photographic recording material according to the invention. The opaque layer is preferably light-reflective, in which case it serves primarily to form a light background for silver image or color image produced. A preferred photographic recording material of this kind comprises the following essential layer elements:

1. a transparent support layer;
2. a light-sensitive element; and
3. a light-reflective opaque layer;

these three layer elements forming an inseperable unit in one of the possible sequences. This means that they are arranged one above the other in such a manner that no time during their preparation storage or processing or during subsequent storage of the processed image the layer elements can be separated under the usual conditions, not even temporarily. In particular, it should not be possible to separate the transparent support layer from the light-sensitive element. The layer elements indicated above are cast one above the other in the usual manner and adhere firmly to each other. It should be particularly noted that developer and processing chemicals should be capable of unrestricted access to the photographic layers from the side remote from the transparent layer support, which means that during processing, this side must not carry any layer which is impermeable to aqueous processing liquids (e.g. another support layer).

In this embodiment the ion exchanger charged with developer is situated in the light-reflective opaque layer or in a layer adjacent thereto, preferably on that side of the opaque layer which is remote from the layers in which the image is to be produced.

The transparent support layer (layer element 1) for the photographic recording material according to the invention may consists of any of the usual transparent support materials used in photographic practice, e.g. films of cellulose esters, polyethylene terephthalate or polycarbonate or other film-forming polymers. For certain arrangements of layers in the photographic recording material according to the invention, it may also be suitable to use opaque support layers, e.g. baryta paper or paper in which the surfaces have been rendered hydrophobic, or pigmented polymer foils.

The light-sensitive element (layer element 2) is also an essential constituent of the photographic recording material according to the invention. It contains at least one light-sensitive, silver halide emulsion layer which may have a non-diffusing color-providing compound, e,.g. a non-diffusing color-coupler or non-diffusing dye releaser, associated with it for the purpose of producing color images. The color-providing compound may be situated in a layer adjacent to the silver halide emulsion layer or it may be contained in the silver halide emulsion layer. For producing multicolor-images in true-to-life colors, however, the light-sensitive element generally contains three such associations of color-providing compound with light-sensitive, silver halide emulsion layer, and the absorption range of the image dye obtained from the color-providing compound generally corresponds substantially with the range of spectral sensitivity of the associated silver halide emulsion layer. Alkali permeable intermediate layers are generally arranged between these various associations of differently sensitized silver halide emulsion layers and color providing compounds, the main purpose of these intermediate layers being to prevent falsification of color. Such intermediate layers are particularly effective if they contain compounds capable of rendering harmless the diffusible oxidation products of the developers.

The terms "association" and "associated" are used to indicate that the light-sensitive silver halide emulsion layer and the non-diffusible color-providing compound are arranged in relationship to each other in a manner such that when development takes place they are capable of interacting to produce a direct or complementary relationship between the silver image formed and the color image produced. For this purpose the light-sensitive, silver halide and the color-providing compound need not necessarily be arranged in the same layer but may be accommodated in adjacent layers both belonging to the same layer unit.

The light-reflective, opaque layer (layer element 3) optionally present is permeable to aqueous alkaline solutions. The main function of this layer is to provide an aesthetically pleasing background for the silver image or color image produced with the recording material according to the invention. This is achieved in conventional manner by means of a layer of binder containing a pale pigment, in particularly a white pigment, e.g. $TiO_2$.

The photographic recording material according to the invention may be used to produce either black-and-white images (silver images) or monochrome or multicolored images, depending on the arrangement. For producing black-and-white images, the process generally makes use only of the silver halide development function of the silver-halide-developer compound which has been incorporated by means of the ion exchanger. Since many of the silver-halide-developer compounds containing amino groups are excellent color developers, the recording material according to the invention may, of course, also be used to produce images by chromogenic development. The visible image is produced either in the light-sensitive silver halide or in the light-sensitive element or in a layer separate from the aforesaid silver halide or element, e.g. by a diffusion transfer process. In the latter case, the photographic recording material may contain, as image receptor layer, a layer containing nuclei for the physical development of silver halide or a layer of binder capable of being colored by diffusible dyes such image receptor layer usually being separated from the light sensitive element by the light-reflective opaque layer. Such an image receptor layer may also be arranged on a separate layer support and together with this support it may form a separate image receptor element with which the photographic recording material according to the invention is brought into contact at least temporarily during development for the purpose of transfer by diffusion.

In one special embodiment, the recording material according to the invention contains a layer comprising an ion exchanger charged with color developer compound arranged on a support layer, which is preferably opaque, and covered with a light-reflective opaque layer above which is a light-sensitive element containing three silver halide emulsion layers differing in their spectral sensitivity, each having associated non-diffusing color couplers.

In another special embodiment, the recording material according to the invention comprises a light-sensitive element with silver halide emulsion layers and non-diffusing color couplers arranged on a transparent support layer and above this light-sensitive element a light-reflective opaque layer above which is a layer containing an ion exchanger charged with a color developer compound. The color image produced as a result of development is visible through the transparent layer support.

In other special embodiments, the light-sensitive, silver halide emulsion layers are not associated with non-diffusing color couplers but with non-diffusing, dye releases while the ion exchanger layer charged with developer is situated between the light-sensitive element and the light-reflective opaque layer, and a layer of binder capable of being dyed by diffusible dyes (image receptor layer) is situated on that side of the light-reflective opaque layer which faces away from the light-sensitive element. The laminate previously described is applied to a transparent support layer with either the image receptor layer or the light-sensitive element facing the support layer.

Development is in all cases carried out by treatment with an alkaline activator bath which releases the silver-halide-developer compound from its attachment to the ion exchanger and enables it to develop the exposed silver halide. If chromogenic development is carried out, it is followed in known manner by bleaching and fixing (or bleach-fixing).

EXAMPLE 1

Charging of an ion exchanger:

60 ml (50 g) of the Na form of a strongly acidic cation exchanger containing sulfo groups (Lewatit® S 100) were applied as an aqueous suspension to an exchanger column (1.8 cm diameter). 1N $H_2SO_4$ was slowly passed through the column until no more $Na^+$ could be detected in the liquid discharged from the column. The column was then washed neutral with distilled water. The ion exchanger was now ready for use and 1000 ml of a 0.05 molar solution of developer compound E 1 in the form of its sulfate were passed through it. Only when 650 ml of solution had passed over the column could the first signs of developer compound be detected in the solution discharged from the column. The column was then washed with 1000 ml of distilled water. The ion exchanger charged with developer was suction-filtered, again washed with water and dried in air.

EXAMPLE 2

A colour photographic recording material was prepared by applying the following layers in the sequence given to a transparent layer support of polyethylene terphthalate 180 μm in thickness:

1. Gelatine layer: 3 μm
2. Cyan layer: 5 μm
3. Gelatine layer: 3 μm
4. Magenta layer: 5 μm
5. Gelatine layer: 3 μm
6. Yellow layer: 5 μm
7. Gelatine layer: 3 μm
8. $TiO_2$ layer: 50 μm In the layers containing color coupler, the proportion by weight of coupler to gelatine was 1:3 and the proporation by weight of coupler to silver (in the form of $AgNO_3$) was 1:1. The following couplers were used:

Cyan coupler

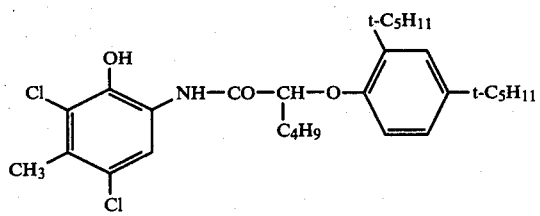

Magenta coupler

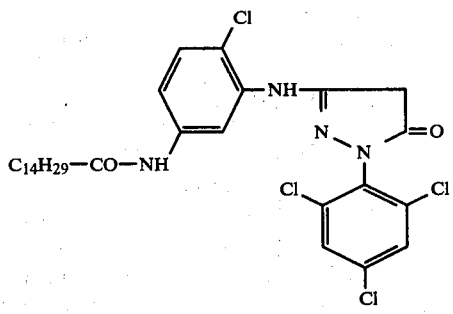

Yellow coupler

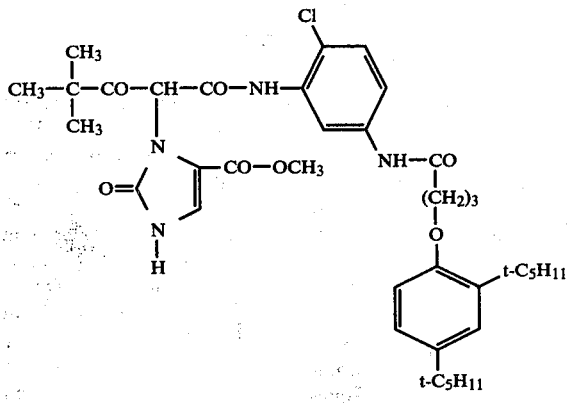

The $TiO_2$ layer was prepared using a casting solution containing $TiO_2$ and gelatine in a proportion by weight of 7:1.

Developer layers were applied to various samples of the color photographic recording material prepared as described above. To prepare these developer layers, an ion exchanger charged with one of the developers, E 1, E 2 or E 3, was first ground down with pestle and mortar and in a ball mill and passed through a screen with a mesh of 0.063 mm to remove coarser particles, and the ion exchanger together with a wetting agent was then stirred into a 5% aqueous gelatine solution, cast as uppermost layer on the color photographic material, and hardened with a carbodiimide hardener.

After intensive exposure through the transparent layer support, the film was developed by immersion in 1N sodium hydroxide solution for 10 to 30 seconds, development was stopped with an approximately 3% buffered acetic acid bath and the film was then bleach-fixed in the usual manner and thoroughly washed.

The resulting color images which were visible through the transparent support layer were comparable in quality to those obtained when a color photographic material identical to that described above but without the developer layer (layers 1 to 8) was developed by conventional chromogenic development using a color developer bath.

We claim:

1. In a photographic recording material comprising at least one light-sensitive silver halide emulsion layer and at least one layer containing a silver-halide-developer compound containing at least one amino group, the improvement according to which the silver-halide-developer compound is contained in the layer in salt form bound to an ion exchanger.

2. The recording material as claimed in claim 1, wherein the silver-halide-developer compound containing at least one amino group is free from sulfo groups and is contained in the layer in salt form bound to a cation exchanger.

3. The recording material as claimed in claim 2, wherein the cation exchanger contains sulfo groups as functional groups.

4. The recording material as claimed in claim 1, wherein the silver-halide-developer compound containing at least one amino group contains at least one sulfo group and is contained in the layer in salt form bound to an anion exchanger.

5. The recording material as claimed in claim 1 wherein the silver-halide-developer compound is a p-phenylene-diamine derivative.

6. The recording material as claimed in claim 1, wherein the silver-halide-developer compound as a color developer compound and a non-diffusing color coupler is associated with the silver halide emulsion layer.

7. The recording material as claimed in claim 1, wherein the silver-halide-developer compound bound in salt form to the ion exchanger is contained in a light-reflective opaque layer or in a layer adjacent thereto.

* * * * *